United States Patent [19]

McCready

[11] Patent Number: 4,521,017

[45] Date of Patent: Jun. 4, 1985

[54] TABLE TENNIS GAME AND TRAINING APPARATUS

[76] Inventor: James B. McCready, 6 Tods Driftway, Old Greenwich, Conn. 06870

[21] Appl. No.: 582,958

[22] Filed: Feb. 23, 1984

[51] Int. Cl.[3] ..... A63B 67/04

[52] U.S. Cl. ..... 273/30; 273/29 A; 273/411

[58] Field of Search ..... 273/29 R, 30, 73 D, 273/29 A, 411

[56] References Cited

U.S. PATENT DOCUMENTS

| | | | |
|---|---|---|---|
| 3,655,187 | 4/1972 | Pugsky | 273/30 |
| 3,717,343 | 2/1973 | Hartford | 273/30 |
| 3,866,913 | 2/1975 | Zimmer | 273/30 |
| 3,999,756 | 12/1976 | Head | 273/73 D |

*Primary Examiner*—Richard C. Pinkham
*Assistant Examiner*—T. Brown
*Attorney, Agent, or Firm*—Howard E. Thompson, Jr.

[57] ABSTRACT

A tennis game and training apparatus comprising a pair of relatively low tables adjustably spaced from a substantially higher and wider net structure to form an assemblage which provides, on a small scale, playing surfaces generally proportional to playing surfaces of a regulation tennis court, whereby side and underhand ball stroking in use of the apparatus affords practice and training for playing on a regulation court. A typical apparatus incorporates a unique net structure 36-inches high and 18-inches deep, and two tables measuring 6-feet in width, 4-feet in depth and 21-inches in height, adjustably spaced from the net structure to dispose remote table edges approximately 12 to 17-feet apart. Each table surface is divided transversely into three equal size playing areas, with the central playing area being added respectively to the left and right playing areas for designating the left and right service courts. The apparatus can be used with standard Ping Pong balls and paddles, although it is preferable to use slightly larger balls and slightly longer handled paddles or racquets.

13 Claims, 7 Drawing Figures

FIG. 1
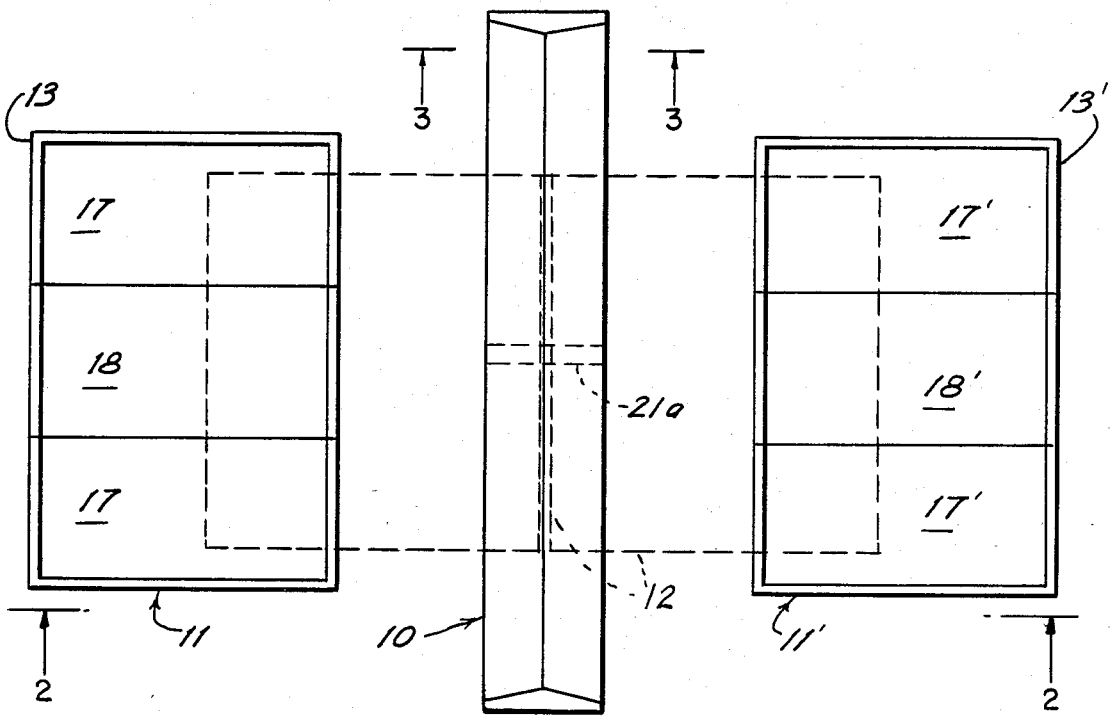
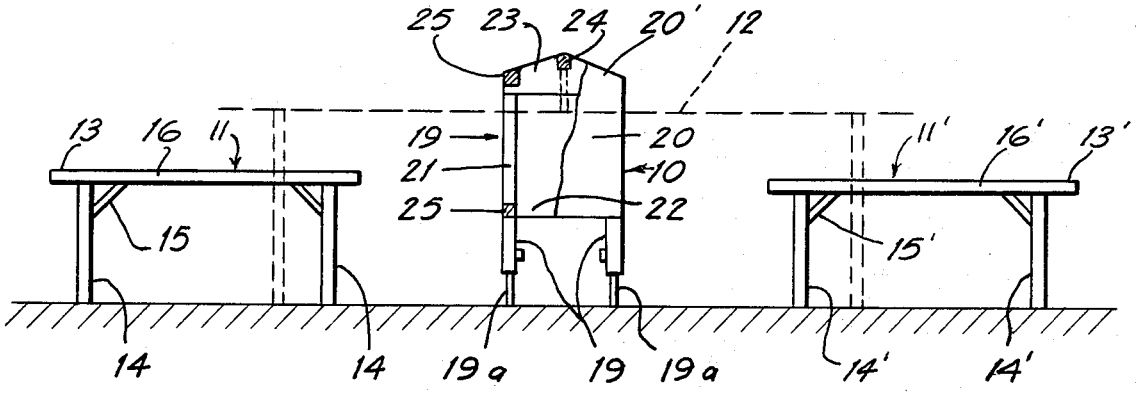
FIG. 2

SIMULATED DOUBLES COURT PLAY

SIMULATED SINGLES COURT PLAY

TABLE TENNIS GAME AND TRAINING APPARATUS

This invention relates to a tennis game and training apparatus comprising a pair of relatively low tables adjustably spaced from a substantially higher and wider net structure to provide an assemblage which provides, on a small scale, playing surfaces generally proportional to playing surfaces of a regulation tennis court, whereby ball stroking in use of the apparatus provides practice and training for playing on a regulation court.

A typical apparatus incorporates a unique net structure 36-inches high and 18-inches deep, and two tables measuring 6-feet in width, 4-feet in depth and 21-inches in height, adjustably spaced from the net structure to dispose remote table edges approximately 12 to 17-feet apart. Each table surface is divided transversely into three equal size playing areas, with the central playing area being added respectively to the left and right playing areas for designating the left and right service courts.

The apparatus can be used with standard Ping Pong balls and paddles, although it is preferable to use slightly larger balls and slightly longer handled paddles or racquets. In either event the side and underhand stroking of the ball when using the apparatus provides helpful training and practice for the playing of tennis and other large scale racquet games.

BACKGROUND OF THE INVENTION

The popularity of tennis, which requires an open space of at least 60-feet by 120-feet to properly accommodate a regulation size court, has stimulated considerable interest in related racquet and paddle games such as platform tennis and paddle tennis having playing courts of substantially smaller size. There has also developed considerable interest in table tennis or Ping Pong which by reason of its small playing surface, approximately 5 by 9-feet, can readily be accommodated in recreation rooms and other confined indoor spaces.

As between tennis, platform tennis and paddle tennis there is sufficient similarity in ball stroking so that players can generally switch between these games without much difficulty and can develop proficiency for all three games through time spent in playing one of the games.

Unfortunately table tennis or Ping Pong, which is played on a table 30-inches high, provides a type of ball stroking which is unique to the game and provides no meaningful practice and training experience which can be helpful to the player of tennis, platform tennis or paddle tennis. Many players of Ping Pong, for example, hold the paddle in the fingers to orient perpendicularly to the arm so that the stroking bears no relation to that in tennis and the like. Even for the player of Ping Pong who holds the paddle, tennis fashion, as an extension of the arm so that side strokes might theoretically be comparable to tennis play, the location of the playing surface is such as to require a quite different angular orientation of the paddle or racquet head than the orientation which would be appropriate in the playing of tennis, platform tennis or paddle tennis.

There is a need, therefore, for a modified form of table tennis of a size to be accommodated in recreation rooms and other confined spaces, which will require a type of ball stroking comparable to that in tennis, platform tennis and paddle tennis to provide useful practice and training for the latter games. A preliminary patent search has failed to reveal any table tennis game which will accomplish this purpose.

The closest prior art developed in the search is U.S. Pat. No. 3,717,343, issued Feb. 20, 1973 to Huntington Hartford for an indoor-outdoor tennis game. This game involves two tables approximately 12-feet wide, 6-feet deep and 26 to 30-inches high. The tables are spaced apart by a distance of 4 to 6-feet and connected by a net disposed essentially parallel to the surfaces of the tables. While the game is described as one which "gives the players the feeling of playing lawn tennis" it falls far short of attaining this goal for several reasons.

Having no elevated net between the tables, the game affords no practice and experience in properly lofting the ball, as is necessary to clear the net in lawn tennis. Furthermore, the height and width of the tables provides playing surfaces so unrelated to the apparent size to the player of the playing surfaces of tennis, platform tennis and paddle tennis that ball stroking in playing of the Hartford tennis game can provide very little in the way of useful practice and training for tennis and the like.

THE INVENTION

The tennis game and training apparatus of the present invention overcomes the problems above-mentioned and provides equipment, compact enough for use in recreation rooms and other confined spaces, in which the playing surfaces bear such relationship to the player and a net structure disposed between the playing surfaces that ball stroking in the playing of the game becomes closely comparable to ball stroking in the playing of tennis, platform tennis and paddle tennis.

Considered in certain of its broader aspects the new tennis game and training apparatus comprises an elongated and elevated net structure in combination with a pair of identical tables having a width somewhat shorter than the net structure, a depth which is approximately two thirds the width and a height of about 18 to 22-inches, the tables being transversely divided into three equal size playing areas, the central playing area being added respectively to the right and left playing areas for designating the right and left service courts, and the tables being parallel to, and equally spaced from the net structure by a distance such that, for a player standing near one table, the remote edge of the opposing table subtends an angle corresponding to the angle subtended by one base line of a regulation court to a player standing on the opposing base line.

The magnitude of the angle subtended by the remote edge of the opposing table is of special significance because angular hand adjustments when playing on properly positioned tables becomes closely comparable to the angular hand adjustments which would be required when playing on a regulation court. The development of skill in playing tennis and the like is attained only through extended practice and training so that angular hand adjustment for particular ball placements becomes automatic. Thus the ability to accumulate meaningful practice in use of the new tennis game and training apparatus should be of considerable interest to tennis players.

The net structure has a width about one and one half times the table width, a depth of about 18-inches, a longitudinal central height of about 36-inches and a top surface which is downwardly beveled toward opposed longitudinal edges. The net structure suitably comprises a light weight, rigid frame covered by a tightly stretched fabric material wherein the fabric material, at least in the portion thereof covering the top of the net structure, has a roughened surface adapted for interaction with a ball contacting such surface.

In a preferred compact adaptation of the game the tables are approximately 6-feet in width, 4-feet in depth and 21-inches high, and are spaced at least 18 inches from said net structure. In such an assemblage the overall length is about 13-feet; and allowing about 4½ to 5-feet of "player space", the assemblage can be accommodated in a room having a long dimension of about 22-feet or more.

When these tables are spaced to dispose the remote edges approximately 13-feet apart, it creates for the player the "illusion" of playing on a regulation doubles tennis court; whereas when remote edges of the tables are spaced about 16-feet apart, it creates for the player the "illusion" of playing on a regulation singles tennis court. Thus, with tables of the size above-mentioned, the 13-foot and 16-foot spacings of the remote edges have special advantage for training purposes, although any spacing within this range can provide an enjoyable table tennis game.

In a slightly larger version of the game, where space permits, the tables might be approximately 9-feet wide, 6-feet deep and 18-inches high and spaced to provide an overall dimension of about 19-feet (to simulate doubles court paly) to about 25-feet (to simulate singles court play). Allowing about 6-feet or more of "player space", this assemblage could be accommodated in a room having a long dimension of about 30-feet or more.

Bearing in mind that the back court in a regulation tennis court for singles play measures 27-feet by 18-feet, i.e. having a width one and one half times its depth, the playing surfaces of the tables above-described are proportional to the regulation singles back court. This adds to the "illusion" above-mentioned in the wider spacing (singles simulating) table arrangement.

The relatively low table height facilitates underhand as well as side strokes. Thus the new game goes far beyond the amusement and interest provided by conventional table tennis or Ping Pong and affords a practical, small scale practice and training apparatus for developing the skills required in tennis and the like.

In its simplest form, and particularly using the smaller size tables above-described, the game can be played with standard Ping Pong paddles and balls. It is preferable, however, to employ paddles or racquets which are slightly longer than Ping Pong paddles, particularly in the handle portion to encourage a tennis racquet type grip with the playing head constituting an extension of the arm. The ball size should preferably be slightly larger than a Ping Pong ball and suitably fashioned in a manner to provide a napped or roughened outer surface. This could be accomplished either by employing a plastic, Ping Pong type ball to which adhesive has been applied to adhere an outer layer of flock material (minute fibrous strands), or alternatively the ball could be a reduced size of a standard tennis ball. The latter version, providing a ball somewhat heavier than the plastic, Ping Pong type ball, would be particularly desirable in instances where the game is set up for outdoor play where prevailing winds could adversely influence the lighter ball.

Depending upon the type ball being used the racquet or paddle head could be varied considerably. A wooden surface, coated on both sides with rubber, as in conventional Ping Pong paddles, is appropriate, particularly when using the plastic, Ping Pong type balls. On the other hand, when using somewhat larger and heavier balls, such as the proposed variation of the tennis ball, it is desirable that the racquet head be a frame strung with interwoven strands as in a conventional tennis racquet. In such variation the racquet, with the elongated handle above-mentioned, would have the appearance of a small size tennis racquet.

Novel features of the new tennis game and training apparatus will be more readily understood from consideration of the following description having reference to the accompanying drawing in which various parts of the apparatus are identified by suitable reference characters in each of the views, and in which:

FIG. 1 is a plan view of a tennis game and training apparatus in accordance with the invention as assembled for use to simulate play on a doubles tennis court having superimposed in dotted lines a conventional Ping Pong table to facilitate visualization of the relative size of components.

FIG. 2 is a side elevation view of the assemblage shown in FIG. 1 looking in the direction of the arrows 2—2.

Figure 5A:
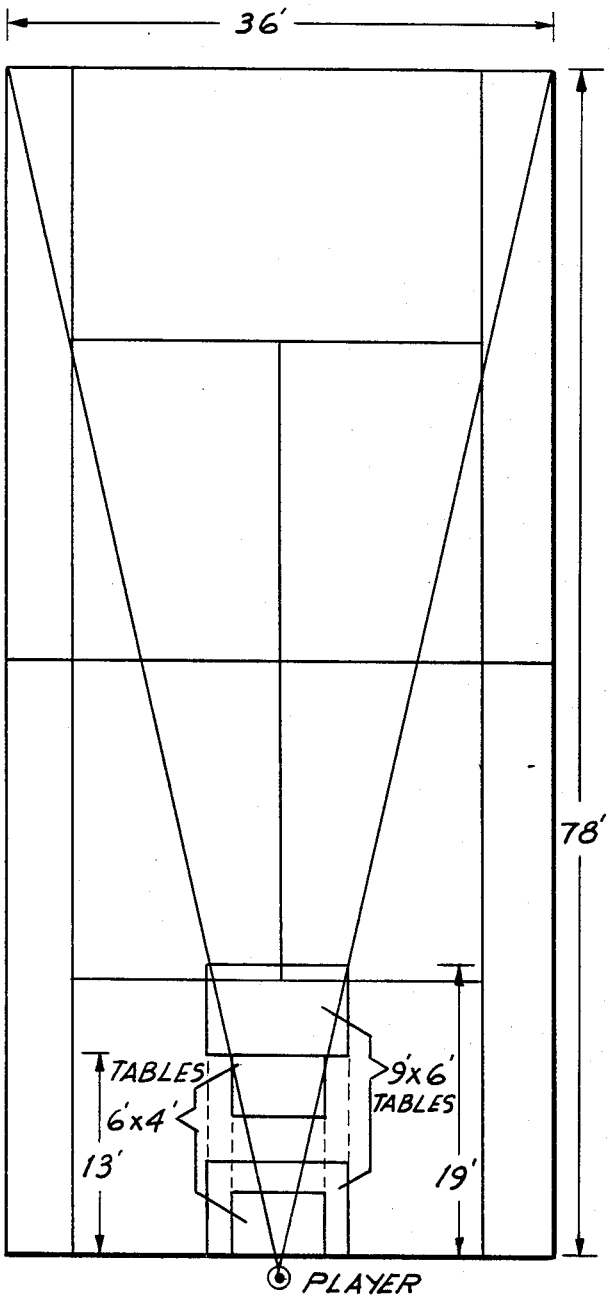
Figure 5B:
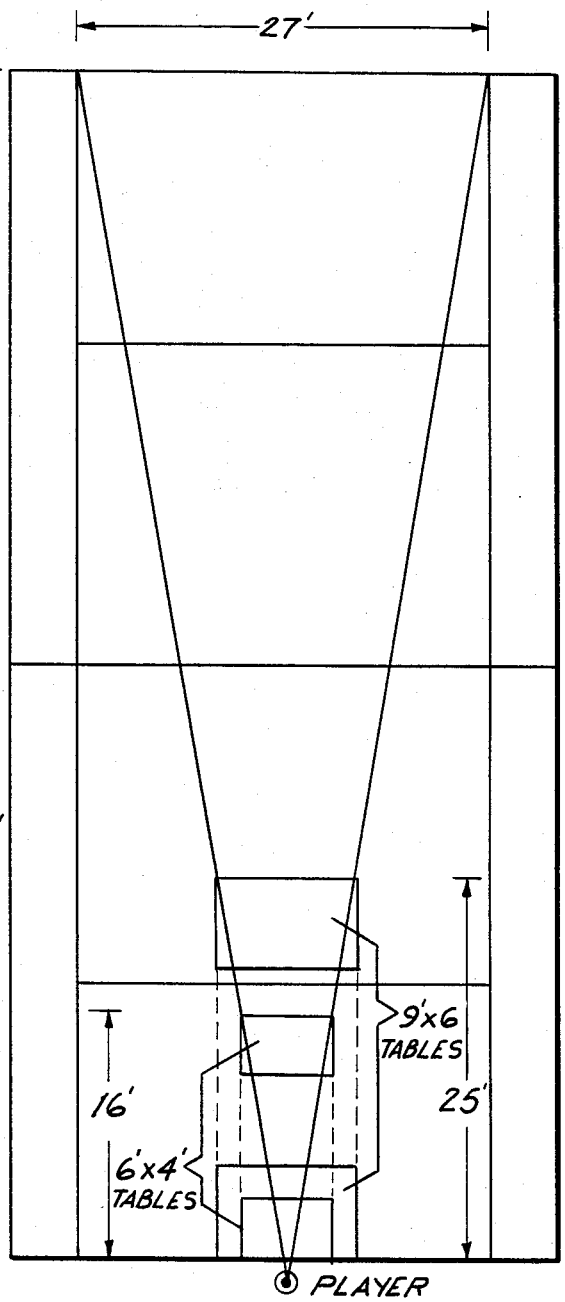

FIGS. 5*a* and *b* are plan views of a regulation tennis courts having superimposed thereon the configuration of components of the tennis game and training apparatus in preferred settings for training purposes in doubles court play and singles court play respectively.

Figure 3:
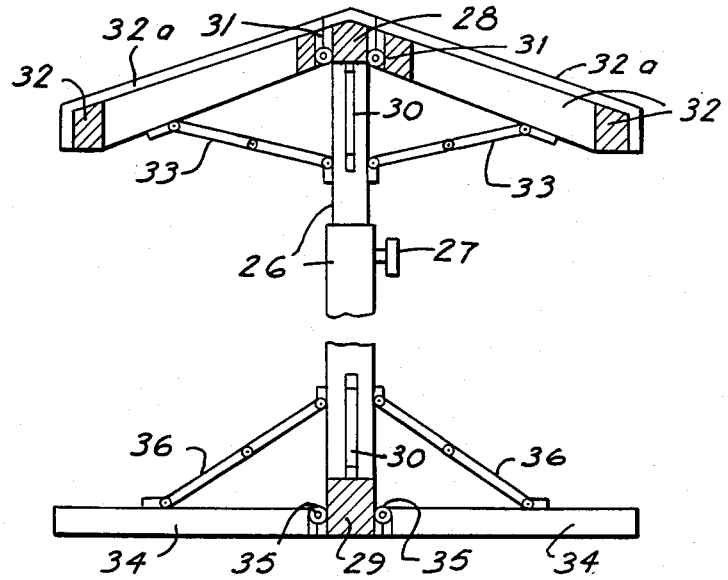
FIG. 3 is a fragmentary sectional view substantially on the line 3—3 of FIG. 1, and showing a modified form of construction.

As shown in FIGS. 1 to 3 the tennis game and training apparatus of the present invention comprises a net structure 10 and two identical tables 11, 11' which are adjustably spaced from the net structure 10. The relative size of these components can be visualized with reference to the dotted outlines in FIGS. 1 and 2 of a conventional Ping Pong table 12 which, as is well known, measures 5-feet in width, 9-feet in length, 30-inches in height and has a net extending 6-inches above the table.

In the showing of FIGS. 1 and 2 the net structure 10 is 18-inches deep, 9-feet wide and 36-inches high and the tables are 6-feet in width, 4-feet in depth and 21-inches high. It will be understood, however, that the relative size of the components can be modified, while maintaining a net structure height of 36-inches, provided that as component sizes are modified the width of the net structure is one and one half times the table width and the table width is one and one half times the table depth.

The illustration in FIGS. 1 and 2 represents a compact adaptation of the invention which can be accommodated in recreation rooms and other confined spaces having a long dimension of at least 22-feet. With the assemblage occupying about 13 to 13½-feet, this allows more than 4-feet of "player space" at each end of the assemblage.

When the space is available it can be desirable to use larger adaptations of the apparatus in which the tables are somewhat larger, lower and more widely spaced from the net structure. By way of illustration, if tables measuring 9-feet in width and 6-feet in depth were employed, the net structure 10 should be about 13½ feet wide, the tables should be about 18-inches in height and the remote edges 13,13' of the tables should be about 19-feet apart to provide a configuration comparable to that in FIG. 1 which, as will more fully hereinafter be discussed, simulates, in certain respects, play on a regulation doubles tennis court. With this larger adaptation of the apparatus and allowing at least 6-feet of player space at each end of the assemblage, it will be apparent that the larger version can be accommodated in a recreation room or other confined space having a long dimension of at least 30-feet, and preferably at least 35-feet as the larger adaptation would stimulate more vigorous play.

The tables 11,11' have corner legs 14,14' which may be a permanent structure or have foldable braces 15,15' with the tops 16,16' being of rigid ply wood or of other material of the type generally used in the construction of ping pong tables. In larger modifications of the apparatus, as for example in the adaptation above-described in which the tables measure 9-feet in width by 6-feet in depth, it may be desirable to have added support of legs at substantially the mid point of the 9-foot edges; and in such larger modifications, for ease of storage and handling, the table top 16,16' could be divided and foldable at the mid point of the 9-foot dimension.

The table tops 16,16' are divided transversely of the long dimension into three equal size playing areas to provide side playing areas 17,17' and central playing area 18,18'. In playing of the game the central playing area 18,18' is combined with the left or right side area 17,17' to provide respectively left and right service areas. In this connection it will be noted that in playing of the game the player uses an underhand stroke to deliver the ball over the net and into the appropriate service court of the opponent's table. This is in distinct contrast to the playing of conventional table tennis or Ping Pong where the service involves a downward stroke to bounce the ball on the server's side of the net and again on the opponent's side of the net.

Except for the different serve above-mentioned the playing of the game proceeds as in most racquet games incorporating a net, with the ball, after bouncing on the near court, being returned over the net to the opponent's court. It will be noted, however, that the low table height permits the arm to be downwardly extended for underhand strokes, quite different from those possible in playing Ping Pong, and generally simulating strokes encountered in conventional tennis.

The net structure 10, which as above-mentioned is 18-inches deep and 36-inches high at its mid section, comprises a rigid, light weight frame 19 covered by tightly stretched fabric 20. As seen in FIG. 2, the frame 19 comprises end legs 21 joined by a lower spacer 22 and an upper templet 23 which positions central longitudinal member 24 and side longitudinal members 25 over which the fabric cover 20 is stretched.

It should be noted that the longitudinal side members 25 are approximately 33-inches high, i.e. approximately 3-inches lower than the central longitudinal member 24, to thereby provide the beveled upper contour to the net structure as shown.

The angular surfaces at the top of the net structure 10 provide interesting ball action when struck during playing of the game, and this action is accentuated if the fabric 20, at least in the top portions 20' thereof, is provided with a napped or otherwise roughened surface to enhance interaction with the ball. The beveled surfaces of the net alert the players to "inefficient" shots while tending to keep the ball in play for prolonged volleys so important to effective practice.

To provide adequate rigidity in the net structure 10, particularly in larger adaptations of the invention, it may be desirable to have additional legs 21, spacers 22 and templets 23 at intermediate points as indicated at **21*a* in FIG. 1** of the drawing.

The net structure height of 36-inches is such as to permit the average adult player to see at least the remote edge of the opposing table during play. In instances where the game and training apparatus is to be used by shorter adults or children, it is desirable that the net structure be lowered to permit the shortest player to see the remote edge of the opposing table. For this purpose the legs 19 should preferably incorporate adjustable extensions **19*a*** to permit the height of the net structure to be easily adjusted within the range of about 30-inches to 36-inches.

To facilitate compactness during storage and shipment the frame structure 19 should incorporate means (not shown for folding such frame structure) to a relatively flatened configuration. The desired compactness in shipment and storage can also be provided by employing the modified form of net structure shown in FIG. 3 in which end legs 26, with means as indicated at 27 for adjusting the height, are connected by top rail 28 and bottom rail 29 and appropriately oriented by braces 30. Secured to the top rail 28 by hinges 31 are frame structures 32 forming beveled surfaces of the net when supported in extended position by the hinged lock members 33 of the type conventionally used on drop leaf tables. The outer surface **32*a* of the frame structure can be a stretched fabric as previously described in connection with FIGS. 1 and 2**, or can be formed of plywood or other rigid material.

The use of rigid material in the surfaces **32*a* would, of course, provide a somewhat different ball action than the stretch fabric and would be particularly desirable when the apparatus is to be used with heavier type balls as hereinafter described. It should be noted in this connection that in the net structure shown in FIGS. 1 and 2** the beveled portions can, if desired, be formed of, or supported by, plywood or other rigid members when the apparatus is to be used with heavier type balls.

The net structure is supported vertically by foldable leg extensions 34 secured to bottom rail 29 by hinges 35, and supported in extended position by hinged lock members 36 similar to the lock member 33.

Figure 4A:
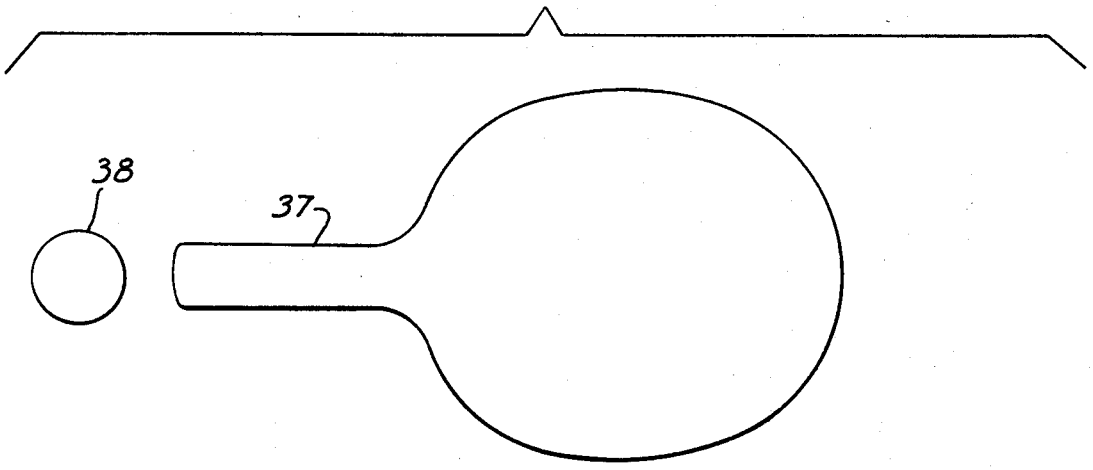
FIG. 4 is a comparative view showing in outline at "a" the size and shape of a Ping Pong paddle and ball, and at "b" the size and shape of a modified paddle (or racquet) and ball for use with the apparatus.
Figure 4B:
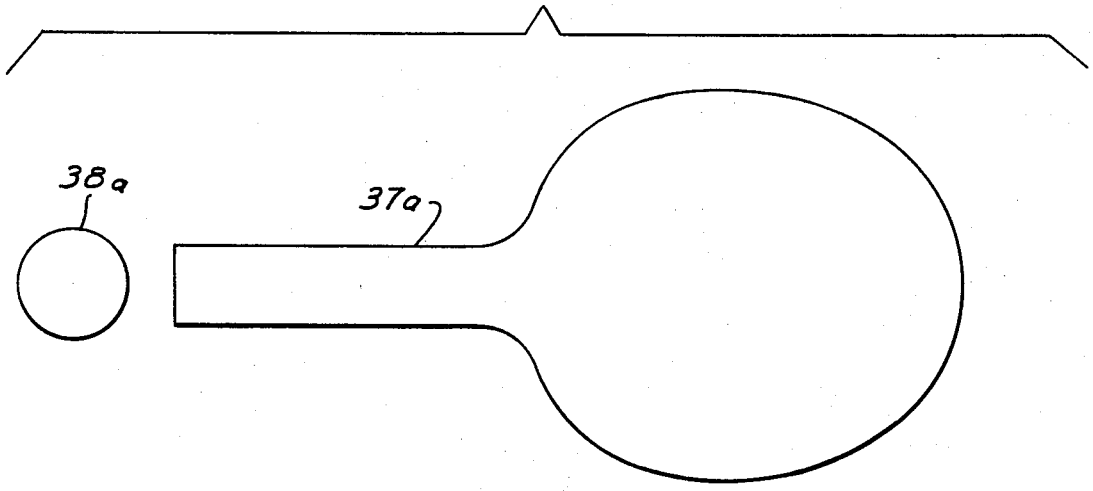

As for the playing implements, i.e. the paddle or racquet and ball to be used, the game can be played, and beneficial training experienced, by using a conventional Ping Pong paddle 37 and ball 38 as shown for comparative purposes in FIG. **4*a*. The dimensions of such a paddle are approximately 11-inches in length with the handle being about 4-inches long and the playing head 7-inches long and 6-inches wide; and the ball measures approximately 1½-inches in diameter. The game becomes more interesting and the training experience more beneficial when using implements of slightly increased size as indicated at 37*a* and 38*a* FIG. 4*b***. Data concerning the critical dimensions of such implements are tabulated below:

| Item | Practical Range | Preferred |
|---|---|---|
| Overall length | 12 to 15 inches | 13 inches |
| Handle | 4½ to 7½ inches | 5½ inches |
| Head Length | 7 to 8 inches | 7½ inches |

-continued

| Item | Practical Range | Preferred |
|---|---|---|
| Head Width | 6¼ to 6½ inches | 6⅜ inches |
| Ball Diameter | 1½ to 1¾ inches | 1⅝ inches |

The playing head can be either of the Ping Pong paddle type in which a plywood member is faced with rubber to provide a somewhat resilient and ball gripping surface, or it can be an elliptical frame, strung with crossed and interlaced strands, as in a conventional tennis recquet. The latter form of construction would be preferred for the player seriously interested in the training experience provided by the apparatus.

Having reference to the weight of a Ping Pong ball which is about 1/12-ounce, the slightly larger ball above-mentioned, when intended for indoor use, should weigh about 1/10-ounce to ⅛-ounce. For outdoor use a sightly heavier ball, suitably weighing about ½-ounce to 1-ounce, would be preferred. The added weight could be provided by adhering to a plastic, Ping Pong type, ball a coating of flock material providing a roughened or napped surface. Alternatively the ball could be a reduced scale of a conventional tennis ball. In this connection it would be noted that even for indoor use the heavier ball and the racquet with the strung head would be preferred by the individual seriously interested in using the apparatus for tennis training purposes.

Various changes and modifications in the tennis game and training apparatus herein disclosed may occur to those skilled in the art; and to the extent that such changes and modifications are embraced by the appended claims, it is to be understood that they constitute part of the present invention.

I claim:

1. A tennis game and training apparatus comprising a net structure having a width, depth and height in combination with a pair of identical tables, each of said tables having a width somewhat shorter than the width of said net structure, a depth which is approximately two thirds its width and a height of about 18 to 22-inches, each table being transversely divided into three equal size playing areas, the central playing area being added respectively to the right and left playing areas for designating the right and left service courts, and the tables being parallel to, and equally spaced from the net structure by a distance such that, for a player standing near the remote edge of one table, the remote edge of the opposing table subtends an angle corresponding to the angle subtended by one base line of a regulation court to a player standing on the opposing base line.

2. A tennis game and training apparatus as defined in claim 1, wherein the net structure has a width about one and a half times the table width, a depth of about 18-inches, a longitudinal central height of about 36-inches, and the top surfaces of said net structure being downwardly beveled from the longitudinal center toward opposed longitudinal edges thereof.

3. A tennis game and training device as defined in claim 2, wherein said net structure is defined by a rigid frame covered by a tightly stretched fabric material.

4. A tennis game and training apparatus as defined in claim 3, wherein said fabric material, at least in portions thereof covering the top of said net structure, has a roughened surface adapted for interaction with a ball contacting such surface.

5. A tennis game and training apparatus as defined in claim 3, wherein said frame includes a rigid backing throughout said beveled surfaces.

6. A tennis game and training apparatus as defined in claim 3, wherein said rigid frame includes adjustable length legs permitting variation of the net height within the range of about 30 to 36-inches.

7. A tennis game and training apparatus as defined in claim 2, wherein said top beveled surfaces comprise planar members hinged to a central longitudinal member, said longitudinal member being supported in elevated position by legs having adjustable means permitting variation of the net height within the range of about 30 to 36-inches.

8. A tennis game and training apparatus as defined in claim 7, including hinged transverse exclusions at the lower ends of said legs, wherein said planar members and hinged transverse extensions are retractably supported in extended position by hinged lock members.

9. A tennis game and training apparatus as defined in claim 1, wherein said tables are approximately 6-feet in width, 4-feet in depth and 21-inches high and are equally spaced from said net structure to dispose remote table edges from about 13-feet apart to simulate doubles tennis play, to about 16-feet apart to simulate singles tennis play.

10. A tennis game and training apparatus as defined in claim 1, wherein said tables are approximately 9-feet wide, 6-feet deep and 18-inches high and are equally spaced from said net structure to dispose remote table edges from about 19-feet apart to simulate doubles tennis play, to about 25-feet apart to simulate singles tennis play.

11. In combination with the tennis game and training apparatus as defined in claim 1, playing and training implements comprising a racquet of a size which is the same as or slightly larger than a Ping Pong paddle and a ball which is of a size the same as or sightly larger than a Ping Pong ball.

12. In combination with the tennis game and a training apparatus as defined in claim 1, playing and training implements comprising a racquet and ball having the following dimensions:

| Item | Practical Range |
|---|---|
| Overall length | 12 to 15 inches |
| Handle | 4½ to 7½ inches |
| Head length | 7 to 8 inches |
| Head Width | 6¼ to 6½ inches |
| Ball Diameter | 1½ to 1¾ inches |

13. In combination with the tennis game and training apparatus as defined in claim 1, playing and training implements comprising a racquet and ball having the following dimensions:

| Item | |
|---|---|
| Overall length | 13 inches |
| Handle | 5½ inches |
| Head length | 7½ inches |
| Head Width | 6⅜ inches |
| Ball Diameter | 1⅝ inches |

* * * * *